US005845364A

United States Patent [19]

Chen

[11] Patent Number: 5,845,364

[45] Date of Patent: Dec. 8, 1998

[54] SHOCK ABSORBENT HANDLE ASSEMBLY FOR A HAND TOOL

[76] Inventor: John Chen, 2F-1, No. 51, Sec. 3, Chung Yang Rd., Lung Ching Hsiang, Taichung Hsien, Taiwan

[21] Appl. No.: 881,002

[22] Filed: Jun. 23, 1997

[51] Int. Cl.[6] ..... A47B 95/02

[52] U.S. Cl. ..... 16/111 R; 16/110 R; 16/DIG. 18; 81/177.1; 81/489

[58] Field of Search ..... 16/110 R, 110.5, 16/114 R, 111 R, DIG. 12, DIG. 18, DIG. 19; 74/543, 551.1; 76/106, 119; 81/177.1, 489, 900

[56] References Cited

U.S. PATENT DOCUMENTS

| | | | |
|---|---|---|---|
| 3,259,132 | 7/1966 | Katter | 81/177.1 |
| 4,509,228 | 4/1985 | Landsberger | 16/114 R |
| 5,193,246 | 3/1993 | Huang | 16/114 R |
| 5,355,552 | 10/1994 | Huang | 16/114 R |
| 5,588,343 | 12/1996 | Rust et al. | 81/489 |
| 5,713,104 | 2/1998 | Giampaolo, Jr. | 16/114 R |

*Primary Examiner*—Chuck Y. Mah
*Attorney, Agent, or Firm*—Bacon & Thomas

[57] ABSTRACT

A hand tool handle with shock absorbent airbag comprising mainly an airbag element within a handle which is designed to fit various hand tools, with the inner hollow space of the handle being designed for embedding of the airbag elements so that an airbag is formed between the handle and the hand tool to absorb shock from reaction of impacting force and consequently the shock being felt by a person holding the hand tool is lowered. The airbag element can be a hollow structure with two legs portions, or a cylindrical hollow structure, or even formed as an inner part of the handle during production.

7 Claims, 4 Drawing Sheets

SHOCK ABSORBENT HANDLE ASSEMBLY FOR A HAND TOOL

BACKGROUND OF THE INVENTION (a) Field of the Invention

The present invention relates to a hand tool handle with a shock absorbent airbag, and particularly a handle within an inner airbag so that the airbag is formed between the handle and an insertion part at an end of the hand tool to absorb shock from the reaction of an impacting force to moderate the shock transmitted to the hand tool operator.

(b) Description of the Prior Art

The conventional hand tool, such as a hammer, usually has the rear section of its handle wrapped with a certain soft rubber or plastic material to provide a considerable friction to help grasping, and to provide a somewhat shock absorption effect to moderate the shock transmitted to the hand tool user. However, since the rubber or plastic wrapped handle is firmly fitted to the insertion part of the conventional hand tool, it does provide some satisfactory shock absorption and helps grasping. In other words, since the shock from the reaction of impacting force is directly transmitted from the hand tool to the handle, the rubber or plastic material only provide a very little shock absorption effect, and which is still far beyond the shock absorption effect required.

SUMMARY OF THE INVENTION

The main objective of the present invention is to provide a hand tool handle with a shock absorbent airbag which is designed to fit various hand tools. The inner hollow space of the handle is designed for embedding an airbag element so that an airbag is formed between the handle and the hand tool to absorb shock from reaction of impacting force and consequently shock being felt by a person holding the hand tool is reduced.

Another objective of the present invention is to provide a design of a hand tool handle with shock absorbent airbag, in which the airbag element can be a hollow structure with two legs portions, or a cylindrical hollow structure, or even formed as an inner part of the handle during production.

BRIEF DESCRIPTION OF THE DRAWINGS

The invention, as well as its many advantages, may be further understood from the following detailed description and drawings in which.

DETAILED DESCRIPTION OF THE PREFERRED EMBODIMENTS

Figure 1:
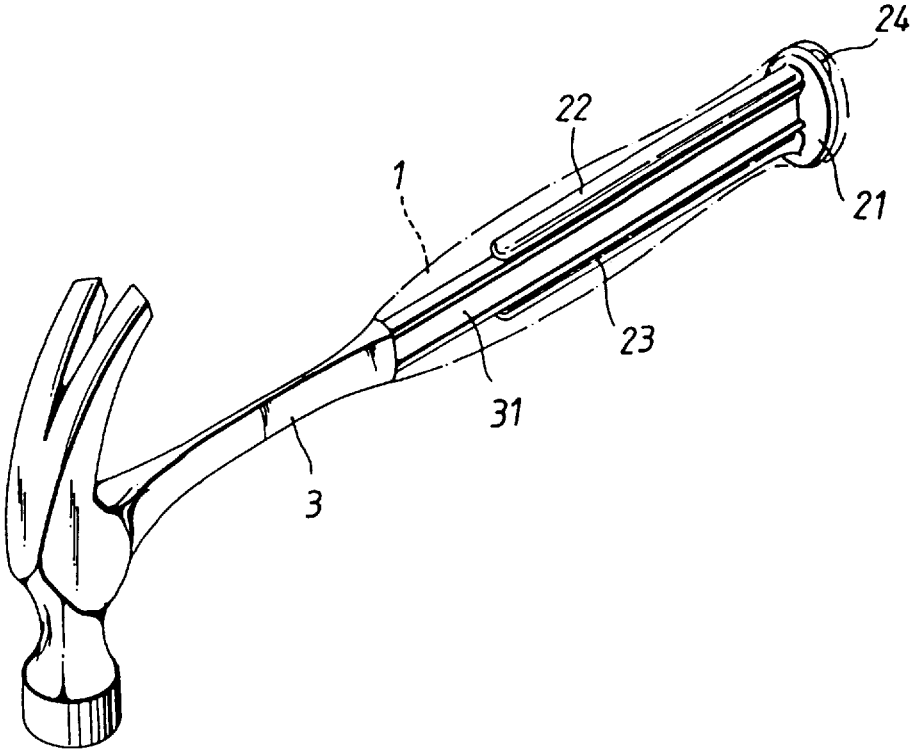
FIG. 1 is a perspective view illustrating an embodiment of a hand tool according to the present invention.
Figure 2:
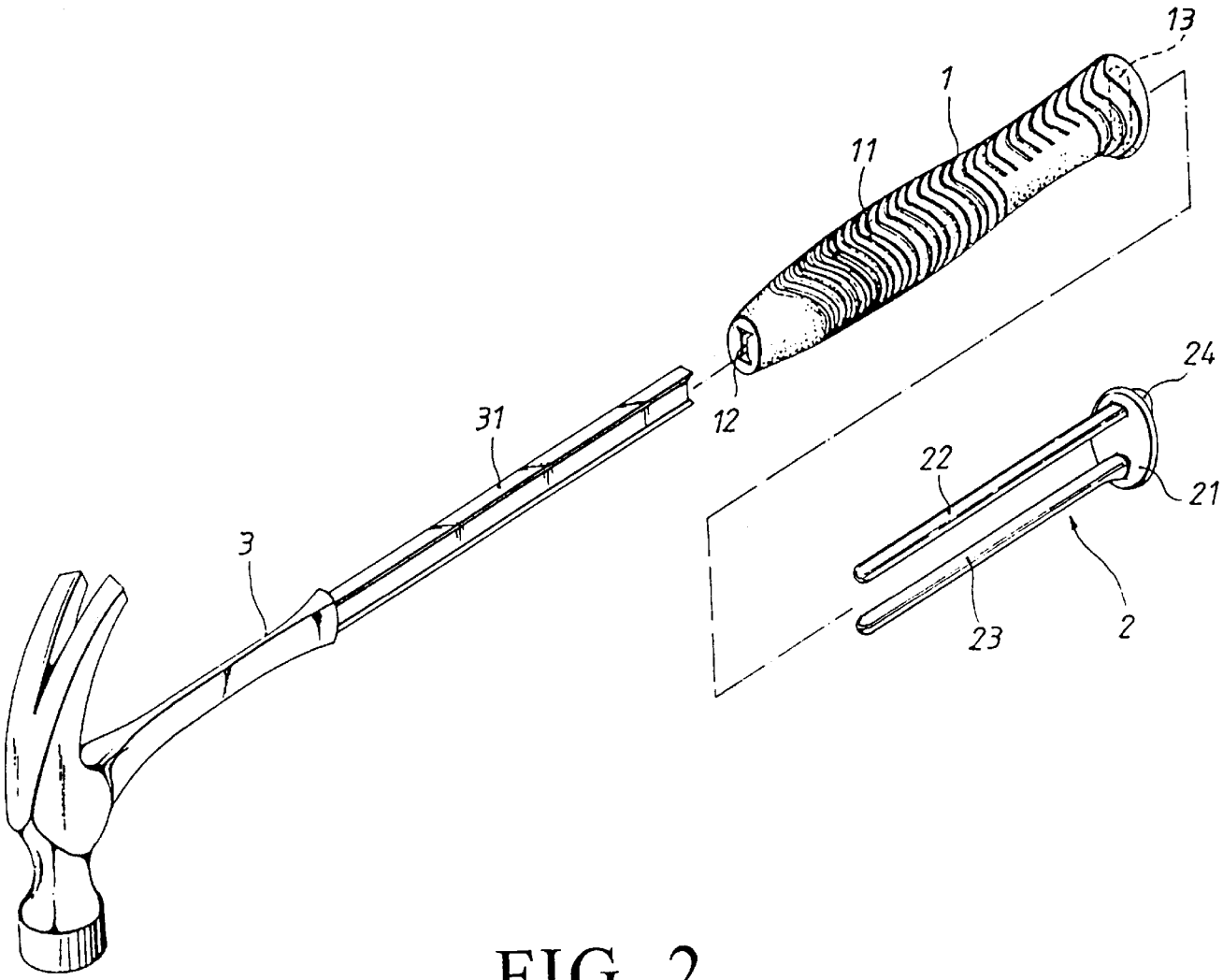
FIG. 2 is a fragmented perspective view of the hand tool with the present invention.

As shown in the attached drawings, the hand tool handle with shock absorbent airbag comprises mainly a handle 1 and an airbag element 2. It can be used for any kind of hand tool. However, in the preferred embodiment described hereinafter a hammer 3 is applied as an example though indeed there is no limitation on its application.

The handle 1 is made of appropriate soft material in the form of a hollow sleeve. It surface is designed with an appropriate pattern 11 to provide a considerable friction to help grasping. The hollow internal space in the handle 1 is designed with a shape corresponding to the shape of the airbag element 2 so that the airbag element 2 can be wholly embedded therein. The front end of the handle 1 is formed with a reception hole 12 having a cross section corresponding to the cross section of an insertion part 31 of the hammer or the hand tool to be applied (in the drawings a H-like cross section is illustrated). A small hole 13 is formed on the other end of the handle 1 so that the airbag element 2 can be embedded therein through small hole 13.

Figure 3:
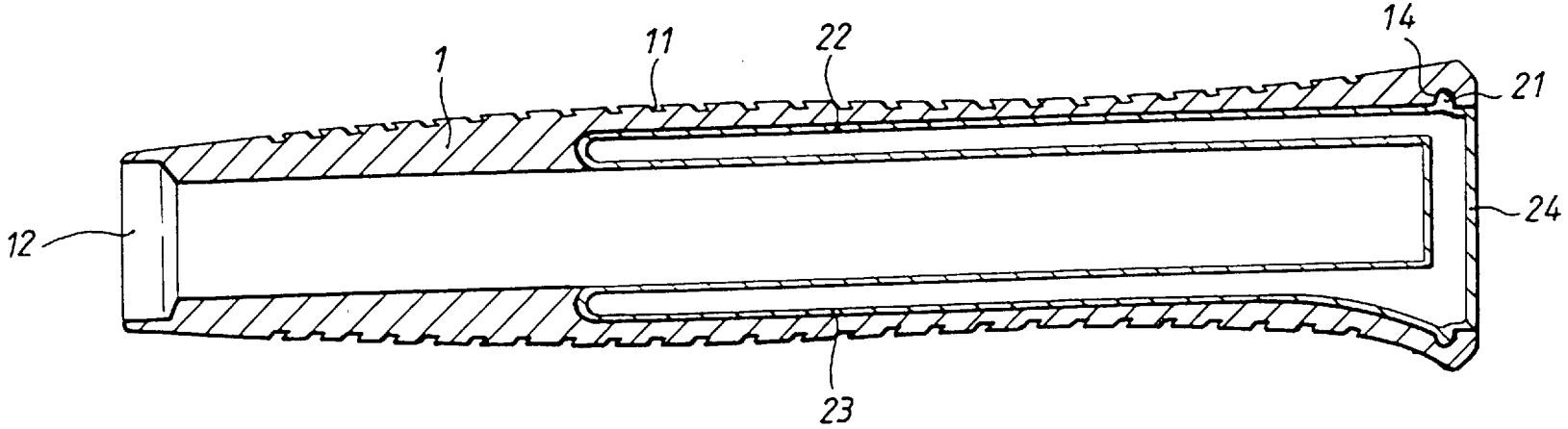
FIG. 3 is a cross sectional view of the present invention without the hand tool.

The airbag element 2, as illustrated by the preferred embodiment shown in FIGS. 1 thru 4, is a sealed hollow element with two or more leg portions. It is designed with a main hollow body 21, an upper leg 22 and a lower leg 23 extend from a side of the main hollow body 21, while its opposite side is formed with a projecting block 24 so that the entire airbag element 2 can be embedded within the interior space of the handle 1 (as shown in FIG. 3) in such a manner that the upper and lower legs 22 and 23 are located on opposite side of the insertion part 31 of the hammer 3 respectively, while the main hollow body 21 is at the end of the handle 1 and its projecting block 24 is exposed at the small hole 13 at the end of the handle 1. However, the airbag element 2 may be designed without such a projecting block 24. The end of the handle 1 can be further designed with an annular groove 14 on its inner wall to retain the main hollow body 21 firmly.

The hammer 3, i.e., the hand tool, has an insertion part 31 extended from its rear end. There is no restriction on the shape of the insertion part 31, and the hand tool can be of any kind besides the hammer 3 shown in the drawings. Therefore, there is no restriction on the shape of the reception hole 12 at the front end of the handle 1 as long as it can receive the insertion part 31.

For assembly of the above components, the airbag element 1 is first inserted from the rear end of the handle 1 and entirely placed within the interior hollow space within the handle 1, while its projecting block 24 is exposed on the small hole 13 at the end of the handle 1. By this way, there is an air bag between the hammer (i.e., the hand tool) and the insertion part 31 within the handle 1 to absorb shock from the reaction of an impacting force. The shock is transmitted via the air bag and consequently, it is moderated so that the shock being felt by the person who holds the hand tool is significantly lowered.

Figure 5:
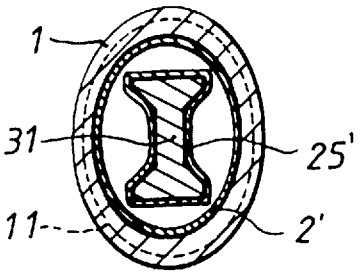
FIG. 5 is a longitudinal sectional view of another embodiment of the present invention.
Figure 4:
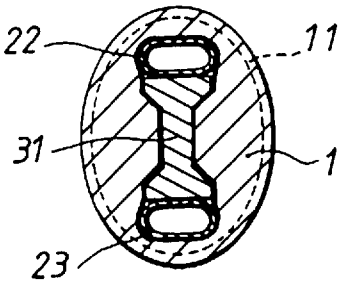
FIG. 4 is a longitudinal sectional view of the present invention with the hand tool.
Figure 6:
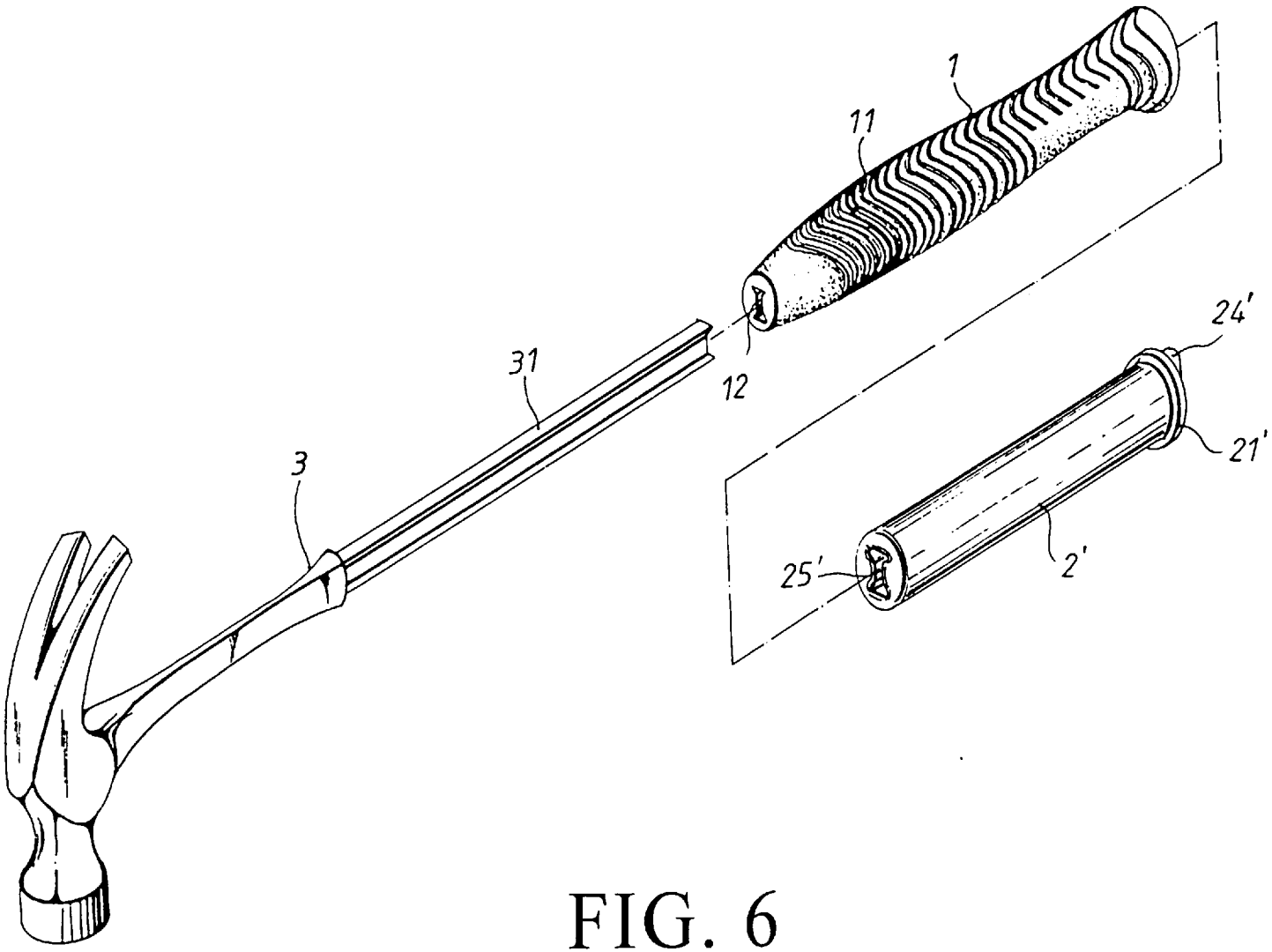
FIG. 6 is a fragmented perspective view of another embodiment of the present invention.

FIGS. 5 and 6 show another embodiment of the airbag element according to the present invention. Besides the structure illustrated in the first embodiment described above, the airbag element 2' can be an independent hollow and sealed cylindrical structure. That is, the airbag element 2' is a hollow cylindrical structure, it has a hole or passageway 25' with a shape corresponding to the insertion part 31 of the hammer 3 (i.e., the hand tool), and it can be entirely embedded within the interior hollow space within the handle 1 so that there is an annular air bag between the hammer 3 (i.e., the hand tool) and the insertion part 31 within the handle 1 as shown in FIG. 5 to absorb shock from reaction of impacting force. Like the first embodiment, the rear end of the cylindrical airbag element 2' can be designed with a circular hollow body 21' and a hollow projecting block 24' for being seized to the wall at the rear end of the handle 1.

The description of the aforesaid embodiments are intended to illustrate the means to achieve the objectives of the present invention, and they should not be applied to limit the conditions for any embodiment of the present invention. Many changes and modifications in the above described embodiments of the invention can, of course, be carried out without departing from the scope thereof. For instance, the handle 1 and the airbag element 2 can be formed as an integrated part in the production process,or the wall of the cylindrical airbag element 2' can be further thickened and formed with any pattern so that it itself is a handle for insertion of the insertion part of the hammer (the handle), or the airbag element is formed as an interior hollow component during forming of the handle. Hence, to promote the progress in science and the useful arts, the invention is disclosed and is intended to be limited only by the scope of the appended claims.

Many changes and modifications in the above embodiment of the invention can, of course, be carried out without departing from the scope thereof. Accordingly, to promote the progress in science and the useful arts, the invention is disclosed and is intended to the limited only by the scope of the appended claims.

What is claimed is:

1. A shock absorbent handle assembly for a hand tool having an insertion part, the assembly comprising:

a) a hollow sleeve handle formed of soft material, the handle including a front end having a reception hole for receiving the insertion part of a hand tool and a rear end having an opening for receiving an airbag element;

b) a hollow sealed airbag element including a main body for disposition adjacent the rear end of the handle and at least two spaced leg portions extending from a front side of the main body for disposition opposite sides of the insertion part; and c) whereby when the insertion part of the hand tool is received within the handle through the front hole and the airbag element is received within the handle through the opening, the leg portions are disposed on opposite sides of the insertion part and the airbag element absorbs and reduces shock resulting from impacting forces during use of the hand tool.

2. The handle assembly of claim 1, wherein the airbag element further includes a hollow projecting block extending from a second side of the main body such that when the airbag element is received within the handle, the projecting block extends outwardly therefrom.

3. The handle assembly of claim 1, wherein the handle includes an exterior surface provided with a shaped pattern for increased friction when the handle is grasped by a user.

4. The handle assembly of claim 1, wherein the handle further includes an annular groove formed in an inner wall thereof for engagement by the main body of the airbag element to retain the airbag element within the handle.

5. The handle assembly of claim 1, wherein the handle and airbag element are integrally formed together.

6. The handle assembly of claim 1, wherein the airbag element is an independent sealed airbag having a hollow cylindrical configuration with a hollow passageway of a configuration corresponding to the configuration of the insertion part, and the airbag element being entirely receivable within the handle to define a hollow annular airbag between the handle and the insertion part of the hand tool.

7. The handle assembly of claim 6, wherein the airbag element further includes a rear end having an annular hollow body and a hollow projecting block extending from the hollow body for securing the element to the rear end of the handle.

* * * * *